United States Patent [19]

Yamamoto et al.

[11] Patent Number: 4,863,313

[45] Date of Patent: Sep. 5, 1989

[54] METHOD FOR LINING TUNNEL WALL FORMED BY SHIELD EXCAVATION

[75] Inventors: Minoru Yamamoto, Machida; Fumitaka Kumai, Tokyo, both of Japan

[73] Assignees: Tekken Construction Co., Ltd.; Minoru Yamamoto, both of Japan

[21] Appl. No.: 199,135

[22] Filed: May 26, 1988

[30] Foreign Application Priority Data

Sep. 30, 1987 [JP] Japan ..... 62-248498

[51] Int. Cl.[4] ..... E21D 9/06

[52] U.S. Cl. ..... 405/146; 405/147; 405/150; 405/141

[58] Field of Search ..... 405/146, 147, 141, 138

[56] References Cited

U.S. PATENT DOCUMENTS

| | | | |
|---|---|---|---|
| 2,995,901 | 8/1961 | Kemper | 405/146 X |
| 3,266,257 | 8/1966 | Larrouze et al. | 405/146 X |
| 4,022,029 | 5/1977 | Jütte et al. | 405/146 |
| 4,222,681 | 9/1980 | Khodosh et al. | 405/141 |
| 4,558,906 | 12/1985 | Takamiya et al. | 405/146 X |
| 4,594,025 | 6/1986 | Manlow | 405/146 X |
| 4,613,258 | 9/1986 | Hentschel | 405/146 X |
| 4,621,948 | 11/1986 | Hentschel | 405/146 |
| 4,645,378 | 2/1987 | Hentschel | 405/146 |

*Primary Examiner*—Dennis L. Taylor
*Assistant Examiner*—J. Russell McBee
*Attorney, Agent, or Firm*—Leydig, Voit & Mayer

[57] ABSTRACT

A method for lining a tunnel wall formed by a shield excavation includes filling a space between the tunnel wall surface and the outer peripheral surface of a lining form in two stages by dividing space into two, portions. One stage of the method is carried out with a ring-shaped rearward end frame ring secured to excavator propelling jacks and disposed to define a first space portion and a second stage of the method is carried out accompanying forward propulsion of the excavator.

7 Claims, 5 Drawing Sheets

METHOD FOR LINING TUNNEL WALL FORMED BY SHIELD EXCAVATION

TECHNICAL BACKGROUND OF THE INVENTION

This invention relates to methods for lining tunnel walls excavated by means of a shield type excavator and, more particularly, to a tunnel wall lining method capable of lining the tunnel wall in conformity to tunnel excavating speed of the excavator.

Shield excavation is a typical tunnel forming method. According to this method, an excavator comprising a cylindrical shield steel body is advanced along a tunnel while with a cutter rotated at front end part of the excavator, excavates the tunnel face. It is necessary to provide a lining against the peripheral wall face of the tunnel which extends behind the excavator.

DISCLOSURE OF PRIOR ART

There has been suggested a method for providing a primary lining wall against the tunnel wall face. Many arcuate segments are coupled to each other and assembled along the wall face into an annular shape. However there has been a problem in the workability or safety within the tunnel in that the arcuate segments which are rather heavy, have had to be assembled within a relatively narrow space of the tunnel.

There has been provided another method in which a primary lining wall is constructed by casting concrete into a space defined between the tunnel wall face and the outer periphery of a lining form. The lining form is assembled annularly along the wall face, and a secondary lining wall is further formed while embedding a timbering or reinforcing bars annularly assembled on the primary lining wall, as has been disclosed, for example, in U.S. patent applications Nos. 927,361 and 048,605 (corresponding to German Patent Applications P 36 38 259.0 and P 37 16 361.2) assigned to the same assignee as in the present case. The workability or safety inside the tunnel can thus be improved since no arcuate segments are required to be assembled.

In the tunnel wall lining method as in the foregoing U.S. patent applications Nos. 927,361 and 048,605, concrete is cast in the space between the tunnel wall face and the lining form through an end frame coupled to jacks for pressing the lining. The excavator is advanced by means of propelling jacks with their plungers projected against forwardmost end of the lining form to gain a propulsion therefrom. Thus, the propelling jacks pressurize the concrete as it cures.

According to this known method, however, the shield excavator is a rather complicated structure. The many propelling jacks are disposed mutually spaced in the circumferential direction within the tail end part of the excavator. In addition, the pressing jacks are disposed mutually spaced in the circumferential direction also in the tail end part of the excavator and radially outside of the propelling jacks. Accordingly, manufacturing costs for the shield excavator are high. Further the required two groups of the jacks occupy a considerably large space inside the shield excavator.

SUMMARY OF THE INVENTION

A primary object of the present invention is, therefore, to provide an improved method for lining a tunnel wall formed by shield excavation, capable of eliminating the foregoing problems. Additional objects include providing a lining wall having a predetermined strength without requiring jacks for pressing the cast lining material, lowering manufacturing costs by structural simplification achieved in the shield excavator, and enlarging effectively usable space within the excavator.

According by the present invention provides a method for lining a tunnel wall involving several cycles which are repeated to build a desired length of lining wall. Each cycle comprises the steps of disposing a substantially cylindrical outer frame member of a predetermined axial length within and spaced from the inner peripheral surface of the tunnel wall and disposing reinforcing members radially inside the outer frame member. Each cycle also comprises assembling inner frame members into a substantially cylindrical shape having substantially the same axial length as the outer frame member, positioning the assembled inner frame members radially inside the reinforcing members, and bringing a ring-shaped end frame secured to jacks provided in a shield-type tunnel excavator for propelling said excavator into engagement across said outer and inner frame members. Each cycle further comprises filling a first space portion defined between said outer and inner frame members with a lining material with said reinforcing members embedded therein, driving said jacks to advance the excavator with a propulsion provided through said ring-shaped end frame and thereby shifting the outer frame member in the direction of the advancing excavator, and filling a second space portion with a lining material, the second space portion being defined between the peripheral tunnel surface and the lining material filled in the first space portion.

In the lining method of the present invention, the filling of the lining material is carried out in two stages. The first space portion can be filled and once the lining material in the first space portion has sufficiently set to withstand the pressing force of the ring-shaped end frame secured to the shield propelling jacks the excavator shield and the outer frame member can be advanced. The lining material can be fed to the second divided space portion under sufficient pressure to counteract the ground pressure, and a satisfactory lining wall can be built. According to this lining method, no separate jacks are required for pressing the ring-shaped end frame, so the shield excavator employed can be simplified and made less expensive while the effective usable space inside the shield excavator can be increased.

Other objects and advantages of the present invention should become clear in the following description of the invention detailed with reference to an embodiment of the invention shown in the accompanying drawings.

While the present invention shall now be explained with reference to the embodiment shown in the accompanying drawings, it should be appreciated that the intention is not to limit the invention only to the particular embodiment shown but rather to include all modifications, alterations and equivalent arrangements possible within the scope of appended claims.

DISCLOSURE OF PREFERRED EMBODIMENT

Figure 1:
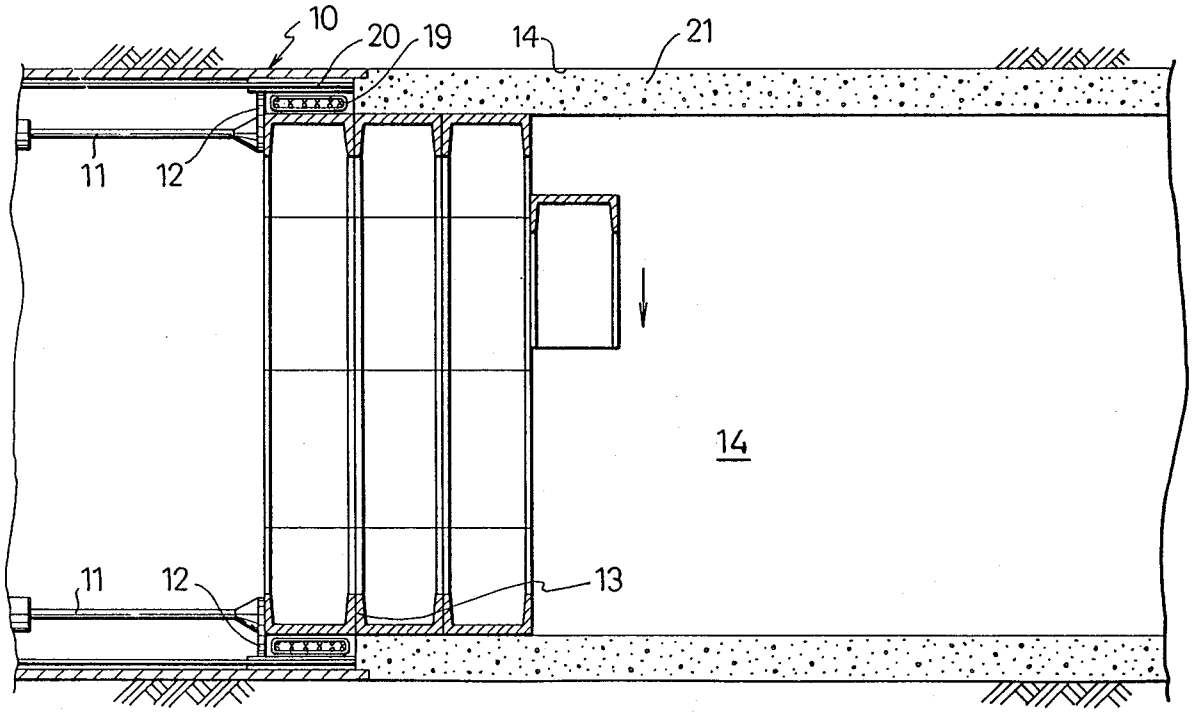
FIG. 1 is a schematic section of a tunnel, the tail end portion of a shield excavator, and assembled lining form members for showing a state in which a lining wall is sequentially built with respect to a tunnel wall face excavated by the shield excavator, which may be, for example, circular in section, in accordance with an embodiment of the lining method of the present invention.

Referring to FIG. 1, a tail end portion 10 of the shield excavator employed in the embodiment of the present invention is shown. As has been well known, the shield excavator itself is provided with an excavating bulkhead defined at front end portion (not shown). In the bulkhead generally a rotary cutter is provided for excavating the tunnel face ground with a supply of, for example, a pressurized liquid so that the excavation can be carried out smoothly while preventing any collapse of the tunnel face ground. While the shield excavator generally employed has been circular in section, an excavator of any other shape, such as elliptic, horseshoe arch, double circular or the like, may be employed, and the sectional shape of the excavator can be freely selected when the tunnel face ground is stable enough. Within the tail end portion 10 of the excavator, a large number of jacks 11 extending in axial direction of the shield excavator are provided for propelling the excavator. The jacks 11, which are disposed along the inner periphery of the tail end portion 10 as, are mutually separated in the circumferential direction and are fixed at their cylinder end to a partition wall or the like inside the excavator. A ring-shaped end frame 12 is secured to the plunger ends of the propelling jacks 11 and is urged to engage a lining form 13 of, for example, annular shape. Thus the shield excavator can be advanced as the tunnel face ground is excavated by extending the actuating plungers of the propelling jack 11 with a propulsion provided by the lining form 13, and the tunnel 14 being formed can be extended.

The lining form 13 is installed separated from peripheral wall face of the tunnel 14 so as to define a lining space between the tunnel wall face and the outer periphery of the lining form 13, in conformity to the shape of the shield excavator. Many of the lining forms 13 are sequentially installed in rows as the excavator advances. The forwardmost row of the lining form is assembled to be positioned inside the tail end portion 10, while the rearwardmost row of lining forms 13 where the lining material has set are disassembled.

Figure 2:
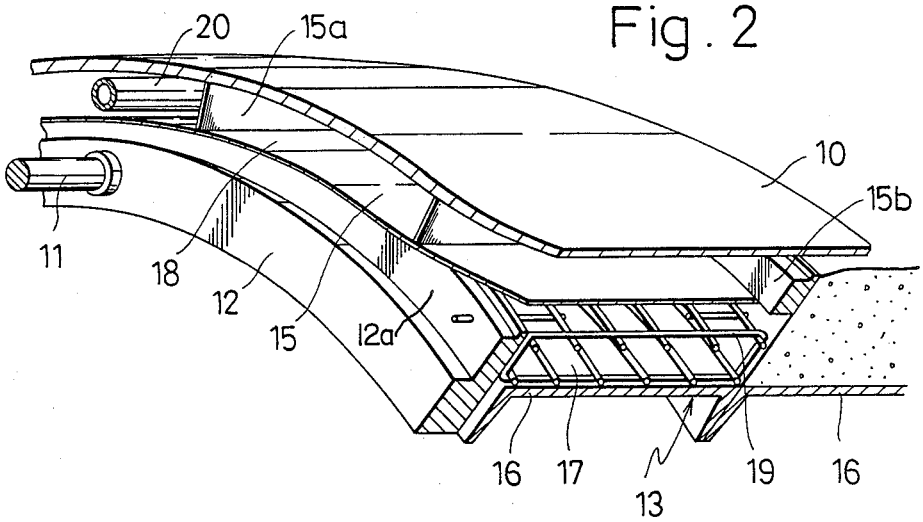
FIG. 2 is a fragmentary perspective view mainly of the lining forms, reinforcing bars and ring-shaped end frame employed in the lining method of FIG. 1 for showing their relationship in a larger scale.
Figure 3:
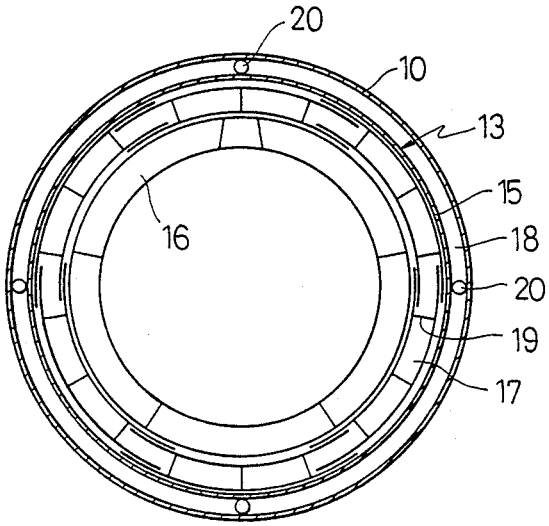
FIG. 3 is a schematic cross-sectional view at the shield, lining form and reinforcing bars of the tunnel of FIG. 1 also for showing their relationship.

Referring more in detail to the lining form with reference to FIGS. 2 and 3, the lining form 13 comprises an annular outer frame member 15, which cooperates with the excavator tail end portion 10 as properly coupled thereto, and inner frame members 16 respectively of an arcuate shape so as to be annular shape when assembled. The outer and inner frame members 15, 16 are substantially the same predetermined length in the axial direction of the shield excavator and are separated from each other in radial direction so as to define between them a first space portion 17 to be filled with a lining material. The outer frame member 15 is provided with radially outwardly extending ribs 15*a* which function as a spacer for separating the outer frame member 15 from the inner wall face of tail end portion 10 for a predetermined distance. The ribs 15*a* also serve coupling means for coupling the frame member 15 to the tail end portion 10 of the excavator. A second space portion 18 to be filled with lining material is defined by these ribs 15*a* on the inner face of the tail end portion 10 and consequently between the wall face of the tunnel 14 and the outer periphery of the outer frame member 15. Further, a closure plate 15*b* capable of closing the rear end part of the second space portion 18 with respect to the advancing direction of the excavator is provided on the outer frame member 15 and projects radially outward ly. In the first space portion 17, reinforcing bars 19 are disposed. Pipes 20 for supplying the lining material are led into the second space portion 18 between the tail end portion 10 and the outer frame member 15. Supply ends of these pipes 20 are passed through the closure plate 15*b* and opened on the lining-material filling space side.

The ring-shaped end frame 12 secured to the plunger ends of the excavator propelling jacks 11 includes an outward extended part 12*a*. The main part of the end frame 12 will be urged to abut the inner frame members 16 while the extended part 12*a* will close the open end of the first space portion 17. In this case, the ring-shaped end frame 12 secured to the excavator propelling jacks 11 of an optimum number is made to have a diameter and shape substantially the same as those of the lining form 13. The ring-shaped end frame 12 may be divided into a plurality segments depending on the number of the excavator propelling jacks 11 employed, the segments being mutually coupled and joined into a single ring form. While not shown in the drawings, other lining-material supply pipes than the pipes 20 are passed through the extended part 12*a* of the ring-shaped end frame 12 or through the inner frame members 16 of the lining form 13 and opended in the first space portion 17.

Figure 4:
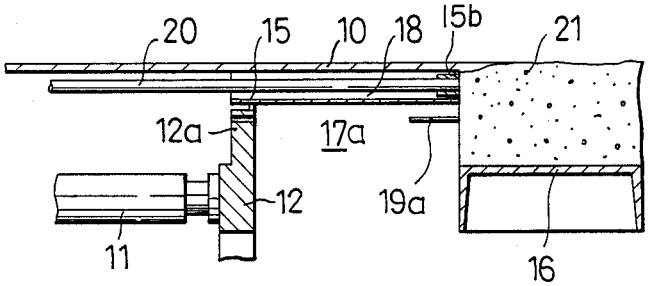
FIGS. 4 to 9 are fragmentary, schematic sectioned views for showing in sequence the respective steps of the lining method of FIG. 1.

Respective steps of the tunnel wall lining method shall be explained next by referring to FIGS. 4 to 9 and with reference to an example in which an annular shield excavator is used. Now, as shown in FIG. 4, the shield excavator excavates the tunnel face ground for one excavation unit length (preferably a distance corresponding to the length of the lining form 13 in the axial direction of the shield excavator) while being advanced from a position of the last built part of a lining wall 21. Thereafter the plungers of the excavator propelling jacks 11 are retracted, separating the ring-shaped end frame 12 from the last installed lining form 13. Upon this separation, only the outer frame member 15 is positioned as shown in FIG. 4 and the closure plate 15*b* as well as the supplying pipes 20 are kept in abutment with the last built part of the lining wall 21. Connecting ends 19*a* of the reinforcing bars 19 project from the last built part of the lining wall 12 into a space 17*a* which becomes the first space portion 17.

Figure 5:
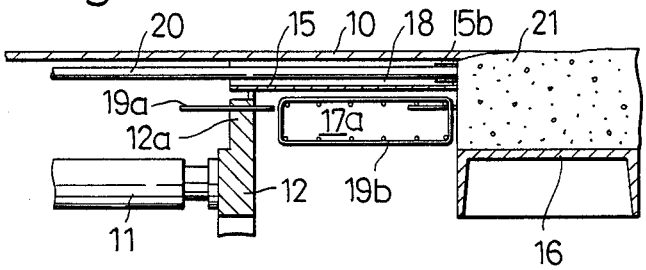
Figure 10:
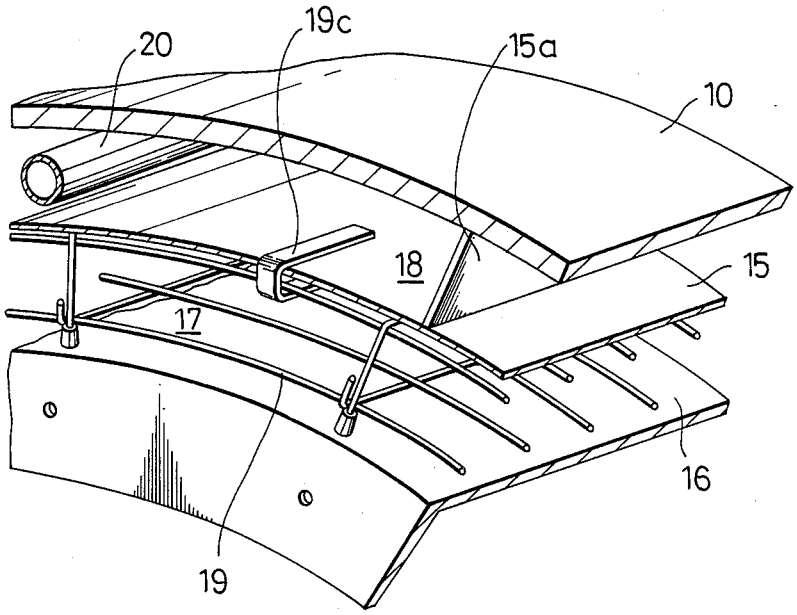
FIG. 10 is a fragmentary perspective view showing a state in which the reinforcing bars are temporarily secured in the lining method of FIG. 1.

The state of FIG. 4 is modified to that of FIG. 5 by connecting in the space 17*a* a new set of the reinforcing bars 19 to the connecting ends 19*a* of the reinforcing bars embedded in the last built part of the lining wall 21. Further connecting ends 19*a* are provided in the space portion and are connected to the set of the reinforcing bars 19. The additional the connecting ends 19*a* project through holes in the extended part 12*a* of the end frame 12 in the advancing direction of the excavator. The reinforcing bars 19 should preferably be formed into an annular cage shape with ring-shaped bar members 19*b*, although any other shape may be employed. In installing the set of the reinforcing bars 19, it is most convenient to have the bars 19 secured to the outer frame member 15 by means of a temporarily securing member 19*c*, as shown in FIG. 10.

Figure 6:
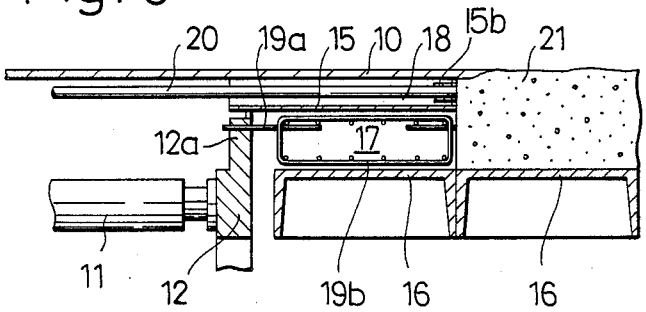

As shown in FIG. 6, next a new set of the inner frame members 16 is assembled into the annular shape. While being tightly engaged to the last installed set of the inner frame members 16, the new set of inner frame members 16 is installed between the last installed set of the inner frame members 16 and the end frame 12 of the retracted plungers of the jacks 11. Here, the first space portion 17 to be filled with the lining material is substantially defined between the outer and inner frame members 15 and 16. Upon assembling the new set of the inner frame members 16, the temporary securing members 19*c* are removed.

Figure 7:
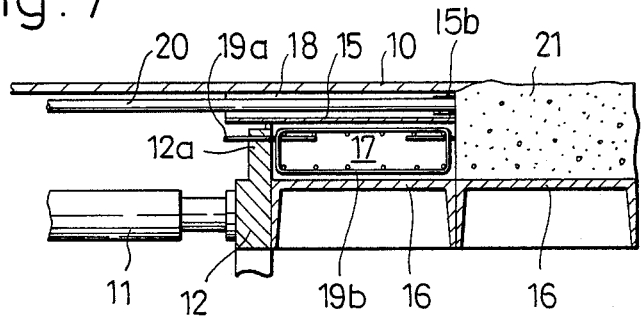

Thereafter, as seen in FIG. 7, the plungers of the jacks 11 are projected toward the newly installed set of the inner frame members 16 to engage therewith the end frame 12 of the plungers. Here, the extended part 12*a* of the end frame 12 is positioned across the outer and inner frame members 15 and 16 so that the extended part 12*a* will directly engage the forwardmost end edge of the inner frame members 16. At the radially outer edge the extended part 12*a* also engages the inner periphery of the annular inner frame member 15 so as not to restrain advancing directional shift of the outer frame member 15 accompanying the advance of the excavator. With this arrangement, the first space portion 17 is completely defined by a lower portion of the forwardmost end face of the last built lining wall 21, radially opposing faces of the inner and outer frame members 16 15, and the extended part 12*a* of the end frame 12 which is positioned across both members 15, 16.

Figure 8:
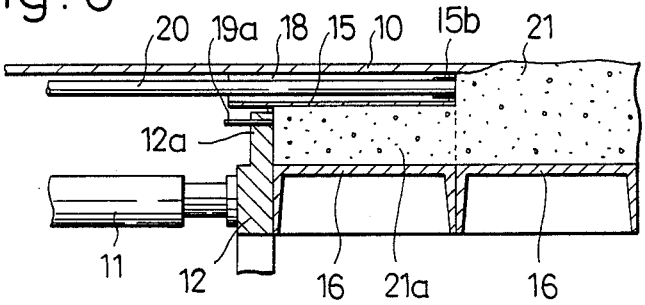

Next, as shown in FIG. 8, a lining material, preferably such as concrete, is filled in the first space portion 17 through the supply pipes provided through the extended part 12*a* of the end frame 12 or the inner frame members 16. The filled material then sets with the reinforcing bars 19 embedded therein to form a rigid, first lining wall part 21*a*. By properly increasing injecting pressure for the filling of the lining material, it is possible to elevate compression force of the lining material.

Figure 9:
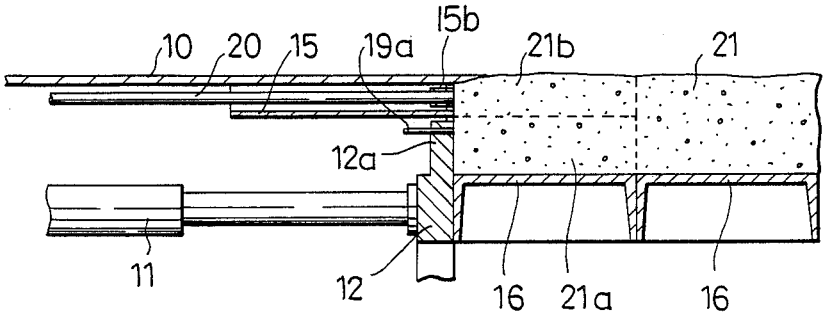

As seen in FIG. 9, next, the plungers of the jacks 11 are projected and the shield excavator as well as its tail end portion 10 are advanced with the propulsion provided by the lining form 13, in particular, by means of the sticking force between the inner frame members 16 and the lining wall 21. Accompanying this advance of the tail end portion 10, the outer frame members 15 and supply pipes 20 are also caused to advance by the one excavation unit length. The second space portion 18 is now defined by an upper portion of the last built lining wall 21, the peripheral wall face of the tunnel 14, the first lining wall part 21*a* formed in the first space portion 17, and the closure plate 15*b* of the outer frame member 15. The lining material such as concrete is filled in the second space portion 18 through the supply pipes 20 preferably under a proper control of the supply pressure. The filled material is set, and a second lining wall part 21*b* is thereby formed. It should be appreciated by any one skilled in the art that the supply pressure of the lining material cast into the second space portion 18 restrains any collapse of the tunnel face ground, whereas the lining material filling is carried out so as not to cause any change to occur in the ground.

With the lining steps as have been described with reference to FIGS. 4 to 9, one lining cycle is completed, and a desired length of the lining wall can be built by repeatedly performing such lining steps.

In building a tunnel of any other sectional shape than the annular shape, the shape and respective constituents of the shield excavator should be modified in response to the shape of the tunnel to be built, and the foregoing lining method of the invention is to be similarly employed with such excavator to attain the same operation and effect as in the foregoing embodiments.

What is claimed as our invention is:

1. A method for lining a tunnel wall, a plurality of cycles of which are repeated to build a desired length of lining wall, each of said cycles comprising the steps of disposing a substantially cylindrical outer frame member of a predetermined axial length within and spaced from the inner peripheral surface of the tunnel wall, disposing reinforcing members radially inside said outer frame member, assembling inner frame members into a substantially cylindrical shape having substantially the same axial length as said outer frame member, positioning the assembled inner frame members radially inside the reinforcing members, bringing a ring-shaped end frame secured to jacks provided in a shield type tunnel excavator for propelling said excavator into engagement across said outer and inner frame members, filling a first space portion defined between said outer and inner frame members with a lining material with said reinforcing members embedded therein, driving said jacks to advance the excavator with a propulsion provided through said ring-shaped end frame and thereby shifting said outer frame member in the direction of the advancing excavator, and filling a second space portion with a lining material, the second space portion being defined between said peripheral tunnel surface and said lining material filled in said first space portion.

2. A method according to claim 1 wherein disposing said reinforcing members includes providing steel bars having a cage shape and projecting connecting bar ends axially beyond the first space to allow further reinforcing bars to be connected thereto in a next lining cycle.

3. A method according to claim 1 wherein bringing said ring-shaped end frame into engagement across said inner and outer frame members includes positioning a radially extended part between an end edge of said inner frame members and an inner peripheral face at an end part of said outer frame member and disposing said extended part so as not to restrain the outer frame member when the excavator advances.

4. A method according to claim 1, further comprising providing pipes for supplying said lining material through at least one of said ring-shaped end frame and said inner frame member and through said outer frame member for carrying out said filling steps into said first and second space portions.

5. A method according to claim 1 further comprising providing a closure plate for closing said second space portion at an end in advancing direction of the excavator and providing pipes for supplying said lining material through said closure plate.

6. A method according to claim 1 further comprising forming a first lining wall part in said first space portion and a second lining wall part in said second space portion in conjunction with said first lining wall part.

7. A method according to claim 6 wherein filling said first and second space portions includes filling said portions with concrete.

* * * * *